United States Patent [19]

Shapland et al.

[11] 4,063,668

[45] Dec. 20, 1977

[54] LADLE GATE VALVE

[75] Inventors: Earl P. Shapland, Champaign, Ill.; James T. Shapland, Pittsburgh, Pa.

[73] Assignee: United States Steel Corporation, Pittsburgh, Pa.

[21] Appl. No.: 609,344

[22] Filed: Sept. 2, 1975

Related U.S. Application Data

[63] Continuation of Ser. No. 150,585, June 7, 1971, abandoned, and Ser. No. 377,385, July 9, 1973, abandoned.

[51] Int. Cl.[2] ..... B22D 37/00; B22D 41/10

[52] U.S. Cl. ..... 222/512; 222/561; 222/600

[58] Field of Search ..... 222/600, 512, 561

[56] References Cited

U.S. PATENT DOCUMENTS

| | | | |
|---|---|---|---|
| 311,902 | 2/1885 | Lewis | 222/561 |
| 506,328 | 10/1893 | Morris | 222/561 |
| 2,789,730 | 4/1957 | Grieselhuber | 222/512 X |
| 3,436,023 | 4/1969 | Thalmann | 222/561 X |
| 3,480,186 | 11/1969 | Grosko | 222/512 |
| 3,511,261 | 5/1970 | Bick et al. | 222/561 X |
| 3,558,256 | 1/1971 | Bick et al. | 222/512 X |
| 3,587,945 | 6/1971 | Lanatti | 222/512 X |
| 3,712,518 | 1/1973 | Meier | 222/600 |
| 3,760,993 | 9/1973 | Meier | 222/561 X |

*Primary Examiner*—Robert B. Reeves
*Assistant Examiner*—Frederick R. Handren
*Attorney, Agent, or Firm*—Jack E. Dominik

[57] ABSTRACT

A teeming valve for use on a molten metal vessel in which yieldable support is provided over the operative surface of a block having a teeming opening which is reciprocated in and out of register with a teeming opening in the vessel. The block is a two piece refractory and the yieldable means are air cooled spring and pressure pads. The method contemplates deflecting relatively movable refractory surfaces to conform the surface of one to the other.

39 Claims, 17 Drawing Figures

INVENTORS
JAMES T. SHAPLAND
EARL P. SHAPLAND
BY Dominik, Knechtel & Godula
ATTORNEYS INVENTORS
JAMES T. SHAPLAND
EARL P. SHAPLAND
BY Dominik, Knechtel, & Godula
ATTORNEYS INVENTORS
JAMES T. SHAPLAND
EARL P. SHAPLAND
BY Dominik, Knechtel & Godula
ATTORNEYS INVENTORS
JAMES T. SHAPLAND
EARL P. SHAPLAND
BY Dominik, Knechtel, & Godula
ATTORNEYS INVENTORS
JAMES T. SHAPLAND
EARL P. SHAPLAND
BY Dominik, Knechtel & Godula
ATTORNEYS INVENTORS
JAMES T. SHAPLAND
EARL P. SHAPLAND
BY Dominik, Knechtel & Godula
ATTORNEYS INVENTORS
JAMES T. SHAPLAND
EARL P. SHAPLAND
BY Dominik, Knechtel & Godula
ATTORNEYS INVENTORS
JAMES T. SHAPLAND
EARL P. SHAPLAND
BY Dominik, Knechtel, & Godula
ATTORNEYS INVENTORS
JAMES T. SHAPLAND
EARL P. SHAPLAND
BY Dominik, Knechtel & Godula
ATTORNEYS

LADLE GATE VALVE

This is a continuation of application Ser. No. 150,505 filed June 7, 1971, now abandoned, and Ser. No. 377,385 filed July 9, 1973 now abandoned.

BACKGROUND OF INVENTION

1. Field of Invention

The field of invention relates to the pouring of molten fluids such as steel, iron, aluminum, and brass. More specifically, the invention relates to a teeming valve, its inserts, and a method of pouring which are all directed to the lower portion of a vessel containing the molten fluid. The general field of the invention is exemplified in James T. Shapland U.S. Pat. No. 3,352,465 dated Nov. 14, 1967 entitled "Refractory Closure Member for Bottom Pour Vessels".

2. Description of the Prior Art

The prior art is exemplified in the above mentioned Shapland 3,352,465 which discloses a bottom pour method and construction in which a plurality of sliding blocks, some imperforate and others having teeming openings are sequentially positioned between the teeming opening and the bottom of the pour vessel. Other relevant prior art includes Fischera U.S. Pat. No. 3,454,201, the Lewis U.S. Pat. No. 311,902 of Feb. 10, 1885, and Pleukharp U.S. Pat. No. 1,507,852.

The subject patents all suffer from various disadvantages. For example, there is no positive yieldable seal provided in Pleukharp 1,507,852. In the Fischera patent 3,454,201 there similarly is no provision for a yieldable seal, nor is a yieldable means provided to accommodate variations in the face of the refractory members. While the Lewis patent 311,902 and Shapland patent 3,352,465 disclose yieldable means for sealing two refractory members, the yieldable support is edge support and not distributed over the interface.

The problem faced by all of the workers in this field is to accommodate abrasion and wear at the working interface between refractories. This problem is further compounded by the nature of refractories which will bend somewhat, and invariably have surface imperfections which must be accommodated at a seal.

It is thus a principal object of the present invention to provide a mechanism and method for reciprocating refractory members each with regard to the other and each having teeming openings in such a fashion that their faces are urged into sealing contact during operation to thereby prevent leakage.

A further object of the present invention looks to the provision of a valve on a pouring vessel which can be reciprocated many times during the life of a pour. For example, a 35-ton charge to a vessel may require 20 shutoffs, and a larger heat as high as 70 shutoffs.

Still another object of the present invention is to provide a teeming valve with inserts which can be readily removed when they become spent, and reversed for further usage, or replaced with new inserts at each time the vessel is recharged.

Still another object of the present invention looks to the provision of a control structure for a teeming valve which is positive, accurate, and resistant to failure.

Still another advantage of the present invention and object which it seeks is to provide a relatively inexpensive modification for any existing pouring vessel so that a reciprocating teeming valve, inserts illustrative of the invention, and the method of pouring can be practiced on an existing construction.

Additional objects and advantages as well as the strides forward which are illustrated in the present invention over the prior art will become apparent as the following "Summary of Invention" proceeds which is not intended to limit the scope of the invention which is expressed in the claims which follow the description herein.

SUMMARY OF INVENTION

The present invention is based upon the discovery that where two refractory plates, each with teeming openings, are reciprocated in and out of register, that an effective fluid seal can be maintained if yieldable pressure is applied to the movable plate at a plurality of positions surrounding the teeming opening and within the periphery of the movable plate. A plurality of yieldable members in a reciprocating carrier apply the necessary pressure. One practical embodiment uses coil springs with a linear deflection to apply the pressure. The springs are constantly air cooled during the pour to prevent their operating temperature from exceeding 500° F. thereby insuring constant yieldable action of the springs without permanent distortion which will occur at higher temperatures. A fixed refractory surface secured to the vessel is yieldably engaged by a sliding member with a refractory surface in yieldable opposed relationship to conform the surface of the sliding surface to the fixed surface, both of which surround registrable teeming openings. The refractory members are preferably peripherally encased in a metal shield, and the slidable member preferably is formed of at least two pieces of refractory, the sliding face portion of which is a high strength abrasive resistant slab backed up and sealed to a less conductive refractory to heat shield the metal frame, reciprocating carrier, and yieldable members. The fractory members are also preferably bilaterally symmetrical to provide for reversibility and reuse. An hydraulic drive is utilized preferably for reciprocation and cooled by the same air flow which cools the springs of the yieldable members. Shielding and sealing is provided at appropriate locations. In an alternative embodiment, a fixed bottom plate having an extension nozzle which may be connected to a submerged pouring tube is provided. In the alternative embodiment the ultimate stream of metal does not reciprocate as the valve gate reciprocates.

DESCRIPTION OF ILLUSTRATIVE DRAWINGS

A further understanding of the invention, its objects, and the field to which it relates will be better understood by the following description of an illustrative embodiment, and more particularly the accompanying illustrative drawings in which:

FIG. 9 is a view comparable to that shown in FIG. 8, but illustrative of the present invention illustrating how the yieldable means accomplish a yieldable pressure interface between the refractory faces thereby effecting the seal required.

FIG. 10 is another sectional view of a refractory plate and a sliding member having a nozzle illustrating how areas are eroded and abraded in devices of the prior art.

FIG. 11 is a view further illustrative of the problems which can occur in devices of the prior art illustrating further where leakage can result where the erosion has gone beyond the sealing faces.

FIG. 12 is yet another view illustrating how the abrasion and yielding effect between two refractory surfaces are accommodated by a teeming valve and inserts illustrative of the present invention.

FIG. 13 is yet another view illustrative of the accommodation of abrasion and wear by a teeming valve illustrative of the present invention.

FIG. 14 is another transverse illustrative view comparable to those shown in FIGS. 8 and 9 illustrating further how contamination or frozen parts still will not render the teeming valve of the present invention inoperative.

DESCRIPTION OF PREFERRED EMBODIMENT

Figure 1:
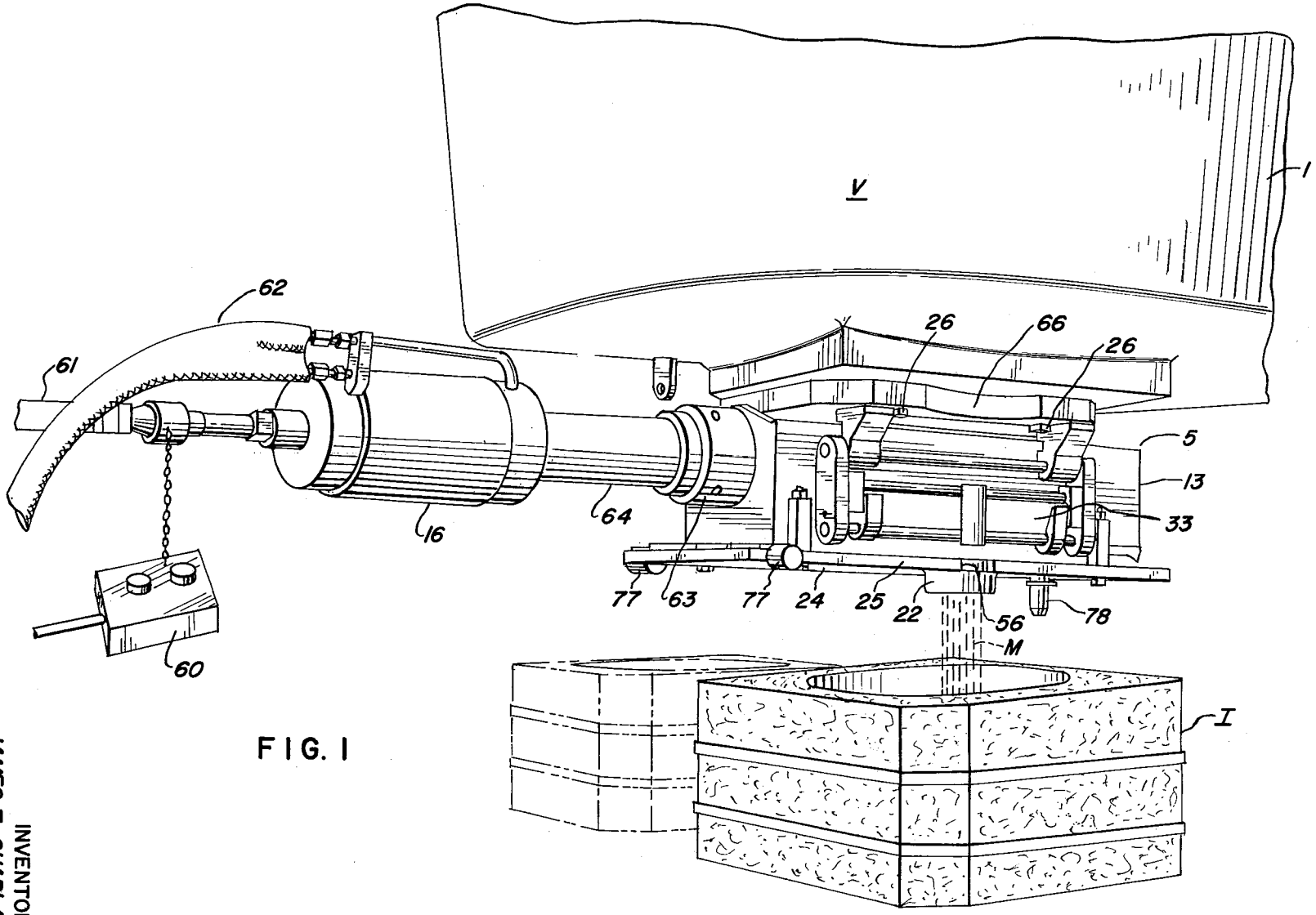
FIG. 1 is a perspective view of a bottom pour vessel modified to use a teeming valve, inserts, and method of pouring molten steel illustrative of the present invention showing the same in position over an ingot being filled.

In broad outline the environment and illustration of the present invention is shown in perspective in FIG. 1. There it will be seen that a vessel V, in this instance illustrated as a bottom pour ladle, having an outer metal shell, has secured at its base a mounting plate 66 to which the sliding gate valve 5 is secured. The sliding gate valve is generally comprised of its main frame 13, and a pair of toggles, the latch toggle 33 being shown, which open and close the same for the replacement of the refractory parts to be described hereinafter. Extending from the lower portion of the sliding gate valve 5 is a refractory 22 which has a central pouring nozzle which, in turn, passes the molten metal M in to the ingot I. A fixed heat shield 24 is provided at the bottom of the sliding gate valve 5, and a sliding heat and spatter shield 25 is provided interiorly to surround the refractory 22 and move with the refractory 22 to thereby serve as an additional heat and spatter shield for the interior portion of the sliding gate valve 5.

The sliding gate valve 5 is actuated by means of an hydraulic cylinder 16 controlled by the control switch 60. The control switch 60, in turn, actuates the hydraulic lines 62 to supply hydraulic pressure fluid to the cylinder 16 which, through a ramrod not shown interiorly of the ram shield 64 drives the operative members of the sliding gate valve 5. Air hose 61 is further provided to continuously flow air through not only the hydraulic cylinder 16 for cooling the same, but the interior portion of the sliding gate valve 5. The entire assembly including the hydraulic cylinder 16, the air hose 61, the hydraulic lines 62, and the control 60 may be removed by rotating the same and as a result, the ram shield 64 has at its end a co-acting member which coacts with the coupler 63 on the sliding gate valve 5 to remove the drive element therefrom. This ready removal becomes significant when the latch mechanism is opened to replace the interior refractory parts within the slidiang gate valve 5 by swinging the same open, and it is desirable to have the drive assembly out of the way. Also when filling the vessel V with its molten charge, the cylinder may be removed to prevent damage due to spills.

Figure 2:
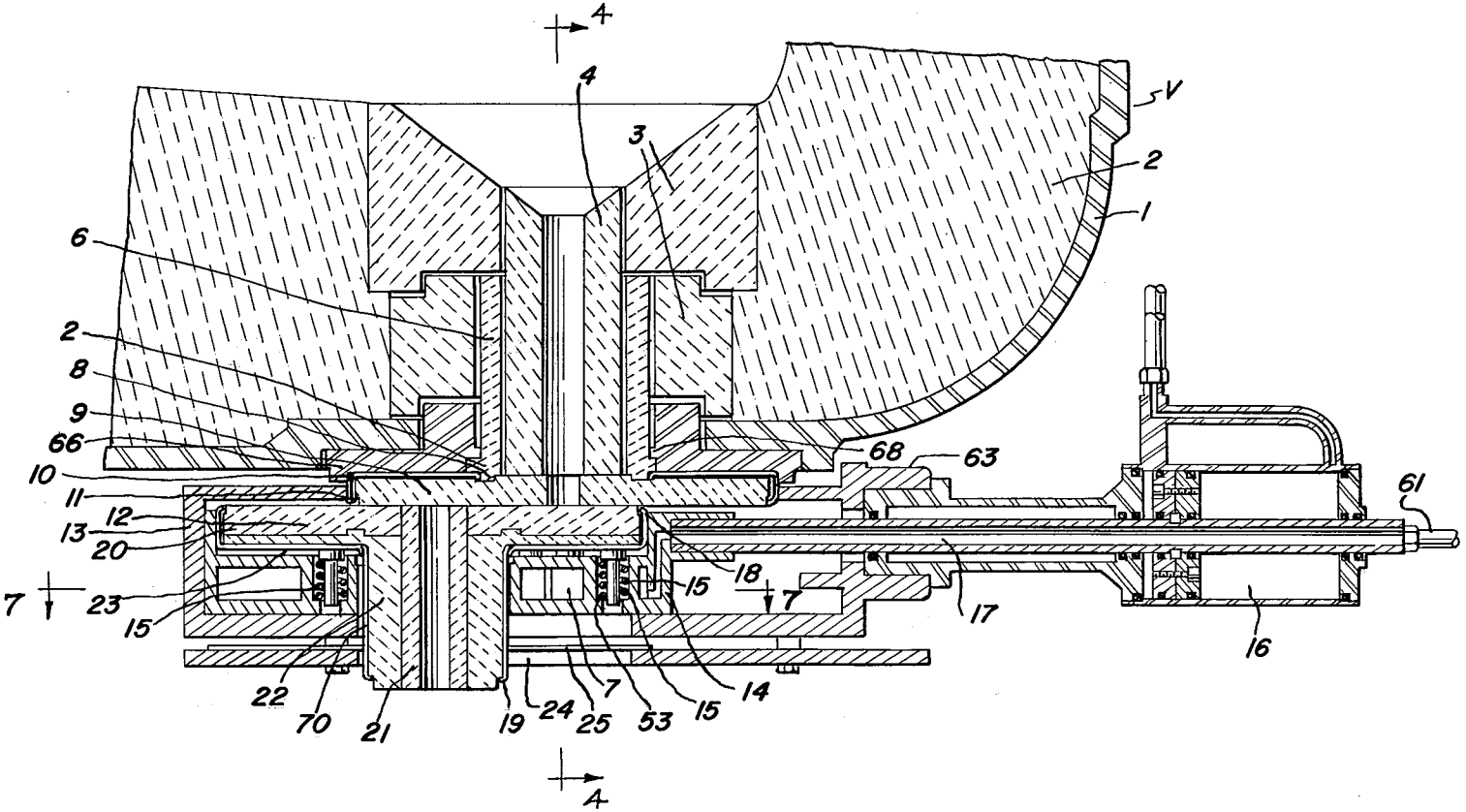
FIG. 2 is a longitudinal sectional view of the teeming valve and inserts illustrated in FIG. 1 showing the same in the shut off position.

Turning now more particularly to FIG. 2, it will be seen that the vessel V has an outer metal shell 1, and a refractory lining 2. As set forth above, this particular vessel is a bottom pour vessel, but it will become quite apparent as this description proceeds that a side pour mounting of the sliding gate valve assembly 5 may also be readily made. The two piece well block 3 is provided at the central portion of the refractory lining 2, and has positioned centrally thereof a working nozzle 4 which extends through the bottom portion of the well block 3 and refractory 2 and the metal liner 1 of the vessel V.

Figure 4:
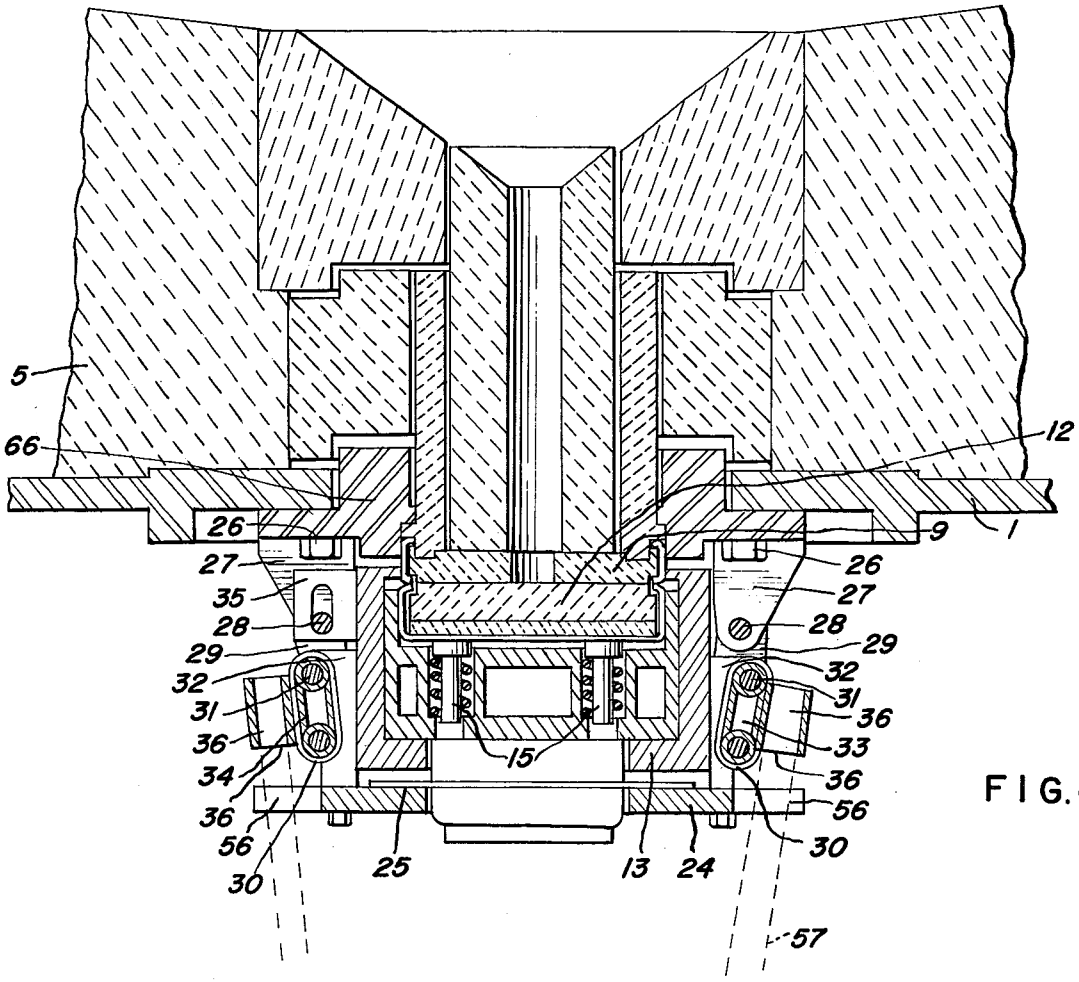
FIG. 4 is a trans-sectional view taken along section line 4—4 of FIG. 2.

The function of the working nozzle 4, and more particularly the safety nozzle 6 as shown in FIG. 2 are coordinated with the position and orientation as well as configuration of the sliding gate valve mounting plate 66. The latter, as shown in FIG. 4 is secured to the metal shell 1 of the pouring vessel V by means of bolts 26. Referring back now to FIG. 2, it will be seen that the mounting plate 66 has a safety nozzle collar 68 which is abutted by the annular ring 8 of the safety nozzle collar 6. The annular ring 8 of the safety nozzle 6 also extends downwardly for engagement with the stationary top plate 9. Thus a labyrinth type joint is provided between the mounting plate 66 of the sliding gate valve 5, the upper face of the stationary top plate 9, and the well block 3.

The working nozzle 4 is normally fabricated from a low cost refractory material and is replaced after each use. The safety nozzle 6, on the other hand, is made of a higher strength refractory and a higher density refractory. The material from which the safety nozzle 6 is formed therefore not only has additional strength in the event of a breakthrough of the working nozzle 4, but because of its more conductive nature, it will tend to cause a freeze off of any liquid pouring fluid which should come in contact with it. The safety nozzle 6, in normal operation, is only replaced when the refractory lining 2 of the vessel V is replaced. In the event of a failure, of course, the same may have to be replaced immediately thereafter. In the event of such replacement, the safety nozzle 6 and the working nozzle 4 are normally replaced at the same time.

Figure 5:
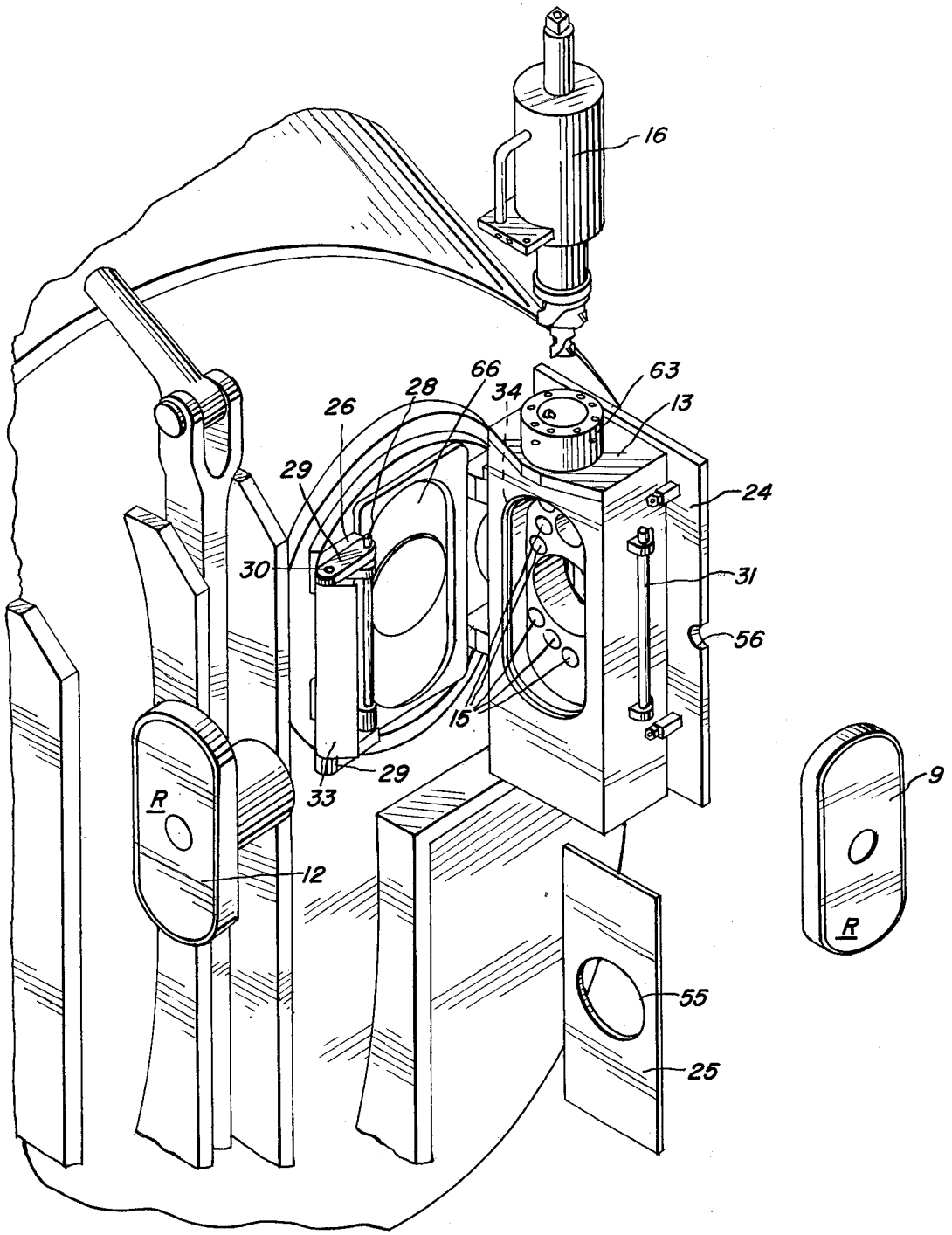
FIG. 5 is a partially exploded partially broken bottom perspective view of the bottom pour vessel illustrated in FIG. 1 but taken from the lower portion thereof with the teeming valve opened for the replacement of the refractory parts.

Referring to FIG. 5, the sequential placing of the stationary top plate 9 can be seen as fitting within the recess in the mounting plate 66. Thereafter the sliding gate 12 is positioned inside the frame 13 of the sliding gate valve 5 and the same is closed to the operative condition as shown in FIG. 2. At this point it will be appreciated that the configuration of the stationary top plate 9 is preferably bilaterally symmetrical about both the axis of reciprocation and an axis perpendicular to the axis of reciprocation. Similarly, it will be observed that the sliding gate 12 is also bilaterally symmetrical about the axis of reciprocation and an axis perpendicular to the axis of reciprocation. Thus after one or more pours have been completed, and it is observed that the erosion leading from the teeming opening of the sliding gate and/or the top plate is not sufficiently detrimental to further use, particularly when the plates are reversed, one or both may be readily reversed and utilized for additional pours.

Referring back to FIG. 2, it will be further seen that the stationary top plate 9 contains a central annular groove proportioned to receive the annular ring 8 of the safety nozzle 6. A metal enclosure 10 surrounds the stationary top plate 9, and is crimped at its periphery to engage the refractory. An opening is provided adjacent the safety nozzle annular ring to provide for a ceramic joint. A mortar filler is desirably inserted between the metal enclosure and the refractory to accommodate irregularities. Thus the stationary top plate refractory material is encased so that in event of cracking, the same will be contained in position.

The sliding gate 12 is similarly encased in a metal shield 70 which is preferably crimped at its lower end 19 and upper periphery 18. Thus both the stationary top plate 9 and the sliding gate 12 are metal encased refractories. In the case of the sliding valve 12, however, the refractory is preferably of a three piece construction. More particularly as shown, a highly erosion resistant refractory sleeve 21 is provided as the pouring spout portion of the sliding valve 12, backed up by a low conductivity refractory portion 22. An abrasive resistant top plate 20 is also provided on the sliding valve member 12 of a material comparable to that of which the stationary top plate 9 is also formed.

Where a highly erosion resistant refractory is referred to, reference is made to that known in the trade which has a high content of alumina, normally in the range of 85% to 95%. These materials are high density, and high temperature fired. The faces of these materials often must be ground to exact shape. On the other hand the backup refractory, such as employed in the well block 3, and the refractory section 22 surrounding the erosion resistant refractory sleeve 21 of the sliding valve 12 are normally formed from a lower alumina porous structure which may be castable. Also usable is a fused silica castable material, but the same is somewhat more expensive than the lower alumina porous structure which is castable, and thus not as adaptable to usage. Mortaring may be used to secure the working nozzle 4 within the safety nozzle 6. The joint between the safety nozzle 6 and the top plate 9 may be effected "dry" without gasket or mortar, the same relying for its security upon the interlocking of parts, and the dissimilar types of refractory material and their behavior in the high temperature pouring environment.

Essential to the satisfactory employment of the invention is the provision of a pressure relationship between the two faces of refractory which slide relative to each other in the sliding gate valve 5. More specifically, by reference to FIG. 5, it will be seen that the refractory surfaces which co-act each against the other, designated by the reference character R, are on the opposed faces of the stationary top plate 9 and the slide gate 12. These are the high erosion resistant refractory faces referred to above. In order to maintain the pressure relationship between the two refractory faces R, provision is made in the sliding gate valve 5 for a plurality of load pads 15. These load pads bear against the underside face of the enclosure 18 of the refractory R of the slide gate 12 and, because there are a plurality of such load pads 15, they constantly urge a sealing relationship between all portions of the interface of the refractory faces R. The load pads 15 bearing beneath the underportion of the slide gate 12 as shown in FIG. 5, bear against the metal enclosure 18 which encases the slide gate 12. Similarly, the metal portion of the stationary top plate 9 is positioned in abutting relationship against the mounting plate 66, and contained in position in the recess provided therein as apparent in FIG. 5. Thus the relative motion in the present embodiment is provided by means of the hydraulic cylinder 16 and its reciprocation of the air cooled slide gate carrier 14.

Figure 16:
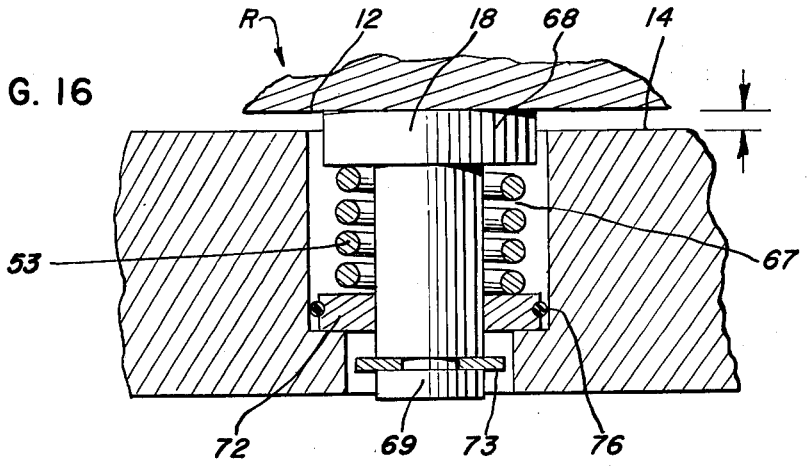
FIG. 16 is a transverse sectional view through a midportion of one of the load pads indicating the same in the normal working position.
Figure 17:
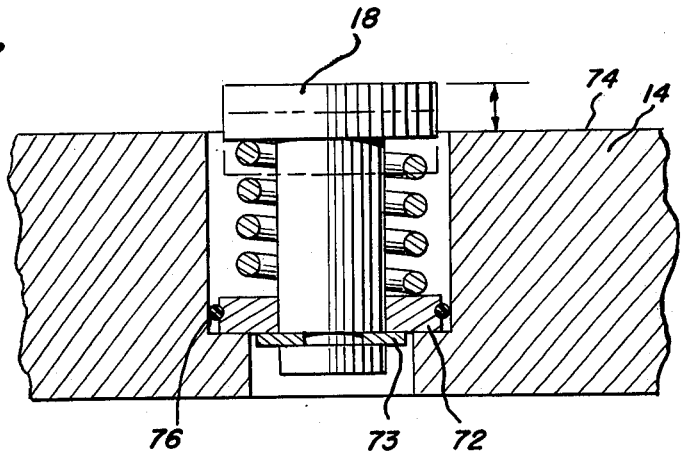
FIG. 17 is a transverse sectional view of one of the load pads showing the same in its preloaded position with the extended limit of travel illustrated.

The load pads 15 as more specifically illustrated in FIG. 16 include a mushroom headed body 67 having a head 68 and a shank 69. The coil spring 71 is positioned beneath the head 68 and surrounding, co-axially, the body portion 69 and biased therein by means of a locking collar 72. The locking collar 72, in turn, has a friction ring 76 which frictionally engages the air cooled slide gate carrier 14 at an interior portion to secure the pressure pad for longitudinal yieldable movement. A snap ring 73 is secured to a groove at the bottom of the shank 69, and as noted in FIG. 17 limits the upward amount of travel when the same engages the collar 72 so that the head 68 of the pressure pad 15 can extend only a certain distance above the face 74 of the air cooled slide gate carrier 14. In normal operation the position and orientation of the collar 72 and snap ring 73 are such to limit the maximum elevation of the face of the head 68 of the pressure pad 15 to one-half inch above the surface 74 of the air cooled slide valve 14 while maintaining a preload on the spring 71. The normal working position, on the other hand, is approximately one-quarter of an inch above the face 14. Thus when the toggle hinge and latch mechanism are employed to secure the slide gate 12 in opposed pressure relationship to the stationary top plate 9 the pressure pads travel beyond the normal working position slightly as the toggles pass over center and return to the normal working position. The total deflection of each spring in this instance is preferably one-quarter inch of preload deflection plus one-quarter inch of deflection present after the toggle hinge and latch mechanisms are operated to place the mechanism in the normal working position. The total deflection of each spring can be calculated into the linear deflection load rate of the coil spring 71 in order that a predetermined loading of the slide gate 12 can be achieved. For best results, this loading should approximate 1000 pounds per load pad 15, and be calculated into the surface area of refractory face R of the slide gate 12 to the end that the pressure on the interface of the two refractories are approximately 100 pounds per square inch.

Referring back to FIG. 2, it will be seen that the rod 17 is activated by the hydraulic cylinder 16, and couples directly to the air cooled slide gate carrier 14 which not only has a plurality of connected air chambers 75 interiorly thereof, but also which supports the numerous load pads 15 which bear against the under surface of the slide gate 12. In the configuration shown in FIG. 2, the rod 17 and its associated hydraulic cylinder 16 are at the far end position and the lip of the slide gate 12 abuts the orifice in the stationary top plate 9 thereby closing the same to fluid flow. It will be noted that the air hose 61 is coupled to the end of the hollow rod 17, and is so proportioned and constructed to deliver a constant stream of air to the interior of the air cooled slide gate carrier 14 and to the numerous air chambers 75 thereby cooling the load pads 15 to a temperature beneath that at which the load pad springs 53 are permanently deflected.

Figure 3:
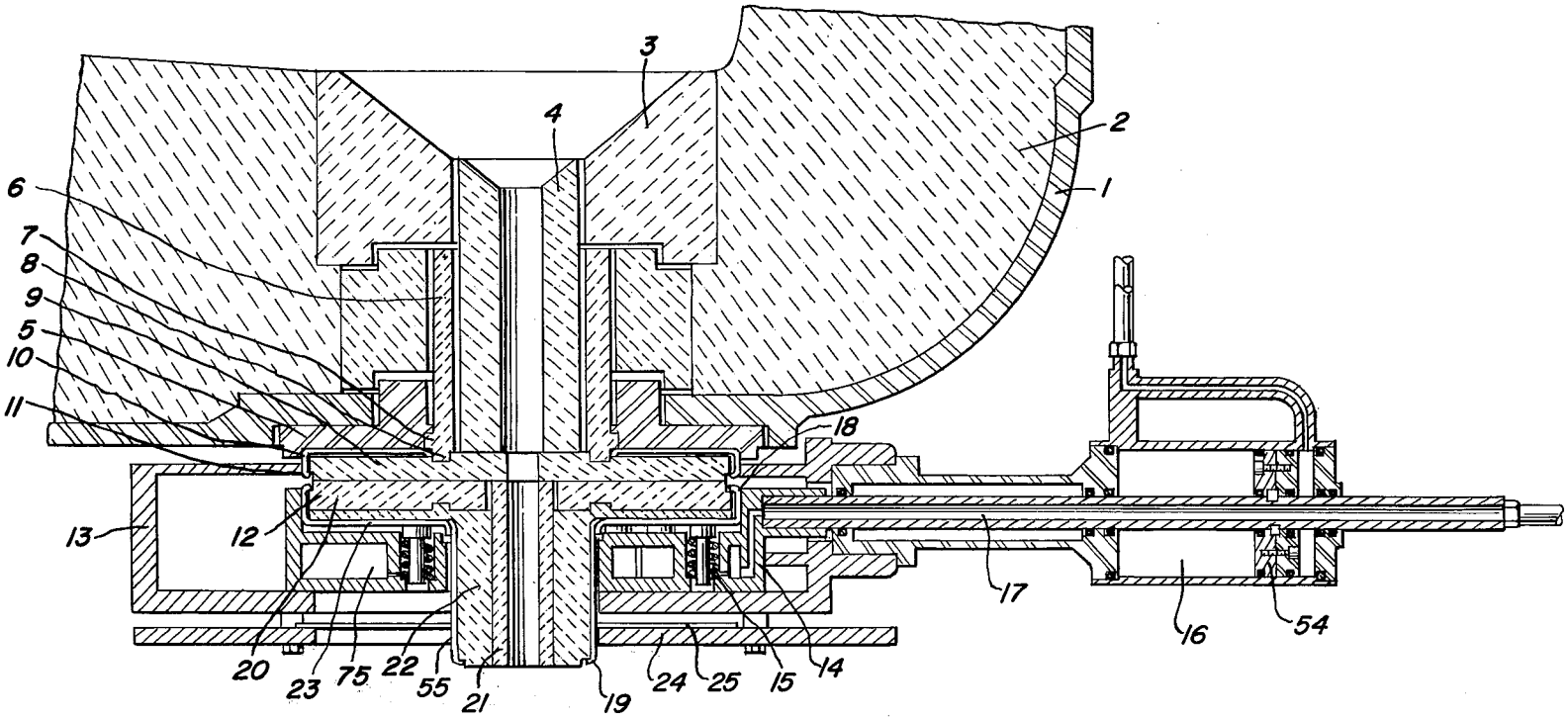
FIG. 3 is a view similar to FIG. 2 but showing the valve in the open or pouring position.

The configuration of the slide gate valve 5 when pouring is best illustrated in FIG. 3. There it will be seen that the hydraulic cylinder, and more particularly the hydraulic piston 54, is at the far position with the rod 17 having pulled the air cooled slide gate carrier 14 to a position wherein all of the pouring nozzles are in axial alignment. At all times during the pulling action, the load pads 15 bear a constant relationship to the slide gate 12, and peripherally surround the pouring nozzle of the slide gate 12, and yieldably urge the upper face R of the slide gate valve against the lower face R of the stationary top plate 9. In addition, to maintain cooling interiorly of the slide gate valve 5, and to also shield against spatter during the pouring, a fixed heat shield 24 is provided beneath the main frame 13 of the slide gate valve 5, and more particularly a sliding heat and spatter shield 25 is provided which has a central opening 55 to surround the extending nozzle portion of the slide gate 12 (see also FIG. 5). Thus as the air cooled slide gate carrier 14 reciprocates from the position shown in FIG. 2 to the position shown in FIG. 3, or any intermediate position, the sliding heat and spatter shield continues to shield the interior of the slide gate valve from both heat and spatter as the nozzle reciprocates, assisted by the fixed heat shield 24. As illustrated in FIG. 5, the sliding heat and spatter shield 25 is readily removable along with the fixed top plate 9 and sliding gate 12, and may be replaced at each time when those two refractory members are replaced. The sliding heat and spatter shield is best formed from a sheet of asbestos, but may also be formed from a sheet of metal, or other material capable of withstanding the temperatures and abrasions of the environment of the subject sliding gate valve 5 while pouring molten metal M. In addition to the fixed heat shield 24, and the sliding heat and spatter shield 25, a sub-shield (not shown) of a material comparable to that from which the sliding heat and spatter shield 25 is formed may be cut, and positioned beneath the fixed heat shield 24. The same is secured to the outboard posts 77 of the heat shield 24 and the orienting pin 78 depending from the heat shield 24. The expendable material used for the same, as well as the sliding heat and spatter shield 25, may be advantageously selected from various types of flexible cement asbestos which, as set forth above, are sufficiently thick and resilient to reciprocate with the slide gate 12 in the environment of the slide gate valve 5.

Important to achieving the objects of the present invention is a means for readily removing, replacing, and reinserting slide gate valves 5 and backup plates 9. This means is provided, as shown in broad outline in FIG. 5, by means of a hinged toggle mechanism 34 and latch toggle mechanism 33. The main frame 13 and its interiorly carried air cooled slide gate carrier 14 are thus swung about the hinged toggle 34 to the open position shown in FIG. 5; the stationary top plate 9 inserted in the recess provided in the mounting plate 66, the heat shield 25 and slide gate 12 inserted through the opening in the bottom of the main frame 13; and then the mechanism swung into the closed position and the latch toggle 33 actuated whereupon the yieldable action of the load pads 15 serve to urge the refractory faces R into contact, and at the same time assist the toggle action of the hinged toggle 34 and latch toggle 33 to close the slide gate valve 5 for actuation by means of the hydraulic cylinder 16 when the unit is assembled through the coupler 63.

Figure 6:
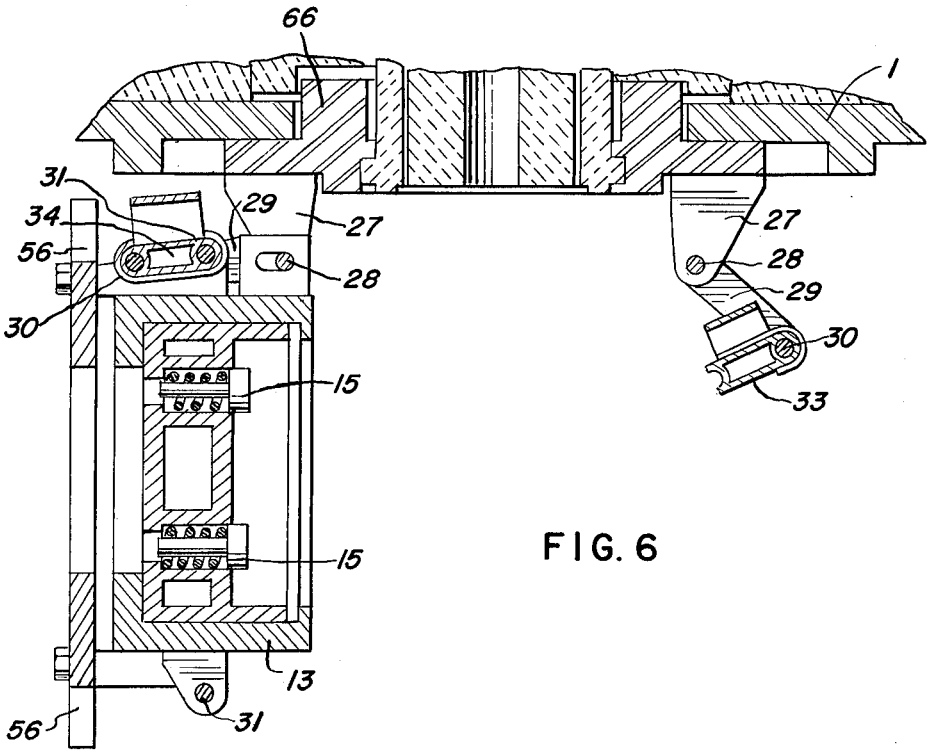
FIG. 6 is an enlarged partially broken section view taken generally from the same elevation and position as FIG. 4 but illustrating the teeming valve, in cross section, in the open configuration much as shown in the perspective view in FIG. 5.
Figure 7:
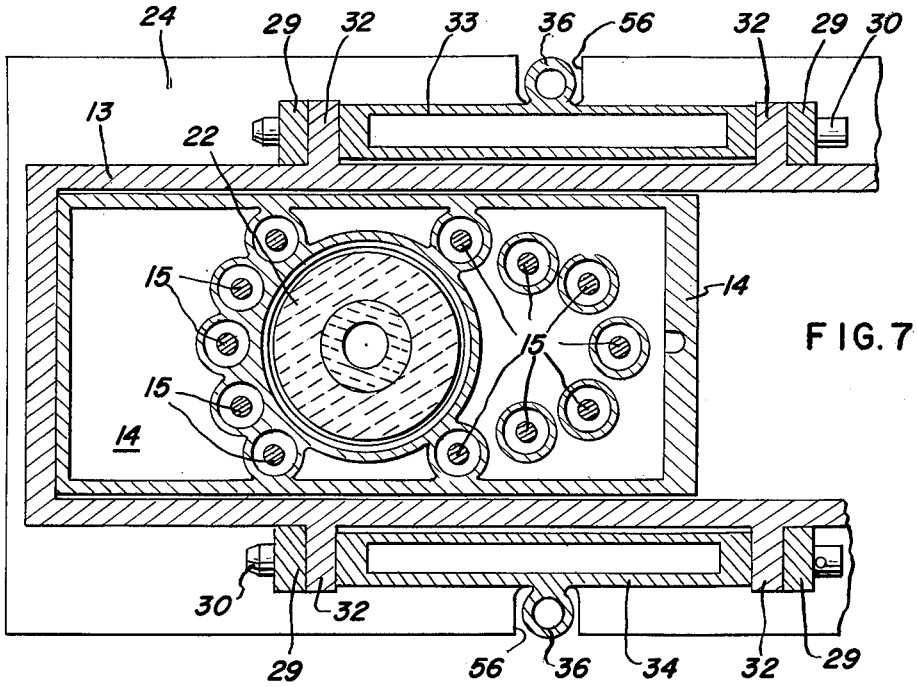
FIG. 7 is a horizontal sectional view taken along section line 7—7 of FIG. 2 illustrating particularly the position and orientation of the yieldable means employed to conform the respective refractory plates thereby effecting the sealing.

By referring to FIG. 6, it will be seen that the mounting plate 66 has opposed depending toggle supports 27. Each of the toggle supports 27 has a pivotal carry pin secured at its base portion, and pivotally secured thereto are toggle links 29. As will be observed at the right hand portion of FIG. 6, the toggle link 29 pivots at its lower portion through carry pin 30 to the latch toggle 33. The latch toggle 33, in turn, is proportioned to engage the latch pin 31 secured to the outer portion of the main frame 13, illustrated at the lower portion of FIG. 6. The hinged toggle 34 is similarly secured by means of links 29 and carry pins 28 to the depending toggle support 27.

Referring now to FIG. 4, it will be seen that the actuation of the respective toggles 33, 34 is achieved by means of providing each of the toggles with a toggle lever socket 36, and providing the fixed heat shield 24 with toggle lever cutouts 56 so that toggle levers 57 (shown in phantom lines in FIG. 4) may be inserted in the toggle lever sockets 36 and pressed toward each other centrally to achieve the toggle lock mechanism, the same being secured in place by means of the pressure of the load pads 15 reacting on the main frame 13 through the air cooled slide gate carrier 14 which houses the load pads 15. It will be noted that the travel of the main frame 13 is restricted to the elongated hole in the bracket 35. Thus the initial travel of the main frame is straight away from the vessel to permit disengagement of the main frame 13, and a separation of the refractory faces R of the slide gate 12 from the stationary top plate 9 upon initial removal. Thereafter the swinging action of the hinged toggle 34 continues when the latch toggle 33 is disengaged by means of the action of the toggle lever 57 when inserted in the toggle lever socket 36. Upon reviewing the action of opening and closing the sliding gate valve 5, it becomes apparent that the function of the load pads 15 is not only to maintain the pressure contact between the refractory faces R, but also to serve as the yieldable means which co-act with the toggle mechanism 33, 34 to close the sliding gate valve 5 in its operative condition. Various additional advantages of the structure shown and described above will become further apparent as the description of the method, and its advantages in diagrammatic form, proceed below.

THE METHOD

The method of the invention will be best understood with a simple relationship expressed to the method of the prior art. By reference now to FIG. 8, it will be seen that the previously disclosed teeming valves of the prior art rely primarily on edge support between the refractory faces R of the stationary top plate 39 and the sliding gate 38. While yieldable supports may be substituted for the fixed edge supports 58 shown here illustrated by bolts, the essential relationship between the refractory faces remains the same, namely that of edge support at the edge support points 37 as shown. By positioning coil springs around the fixed supports 58, the same will yieldably urge the mounting structure base 40 against the refractory members and the fixed support member 41, but still (as exaggerated in FIG. 8) because of the support at the edges 37 a gap (here exaggerated) exists between the refractory faces R.

Figure 8:
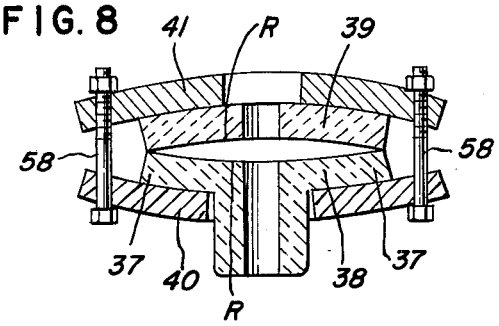
FIGS. 8 through 14 are all sectional diagrammatic views illustrating various problems and their solution, FIG. 8 in particular being a transverse sectional view illustrating how devices of the prior art which secure one refractory plate to another fail to achieve a uniform sealing action between the refractory faces.
Figure 9:
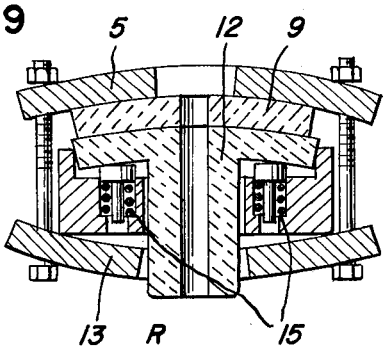

The present invention is directed to accommodating the irregularities in the fluid seal which occur between the refractory faces R and surrounding the teeming openings, such as shown in FIG. 8. This is done by confining one of the refractory surfaces, such as the fixed or stationary top plate 9 (see FIG. 9) for relative motion with regard to the other refractory member, such as the slide gate 12. Thus the refractory interfaces R in the method of the invention as illustrated in FIG. 9 are moved in and out of register to provide for pouring or shutoff. The primary difference between the method of the present invention as illustrated in FIG. 9 and that of the prior art as illustrated in FIG. 8 is, of course, a result of positioning a plurality of yieldable members (15) to yieldably urge the refractory faces R against each other. Additionally, it will be noted, as disclosed in FIG. 9 and elsewhere in FIGS. 1 through 7, that the orientation of the yieldable members is such that they surround the teeming openings, and are within the periphery of the outer edge of the fixed refractory surfaces. Thus the movable refractory surface is relatively deflected to conform to the irregularities of the surface of the fixed refractory members.

Thus in the method and apparatus illustrative of the present invention shown diagrammatically in FIG. 9, the warpage of the fixed or stationary top plate 9 and the sliding valve 12 is accommodated by the pressure of the load pads 15, whereas the comparable warpage as shown in FIG. 8 of the stationary top plate 39 and the sliding gate 38 is not so accommodated to provide an interfacial constant relationship between the refractory faces R.

Figure 10:
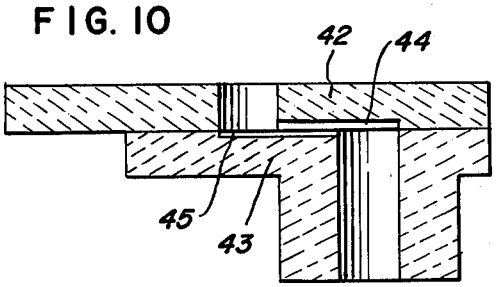
Figure 11:
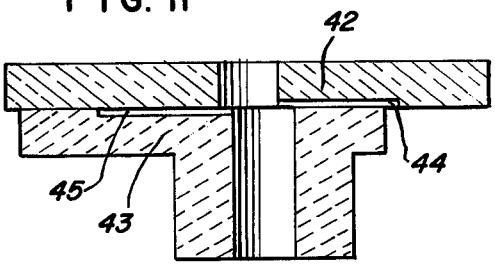

Further, as illustrated in FIG. 10, it will be noted that the schematic stationary top plate 42, and sliding gate 43 illustrative of the prior art devices disclose reciprocating slide gates. A broad erosion and abrasion at the edges 44, 45 may occur. Indeed, after repeated cycles the abraded area of the top plate 44, as best illustrated in FIG. 11, overlaps the periphery of the slide gate 43 and opens a path for molten metal to flow directly from the stream normally confined by the slide gate 43 to the exterior portion of the valve. The situation is further aggravated by the partial opening or throttling as shown in FIG. 11 which invites the molten metal to abrade the surface and flow out in the right hand portion as shown therein. Additionally, upon reflective review of FIG. 10, it will be seen that even in the closed position, the abrasion discussed with regard to FIGS. 10 and 11 invite a leakage, or alternatively a freeze off in this area. The leakage can be tolerated, so long as the same is through the normal pour spout and shut off can be achieved.

Figure 12:
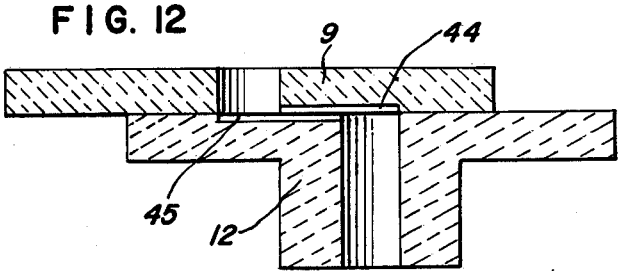
Figure 13:
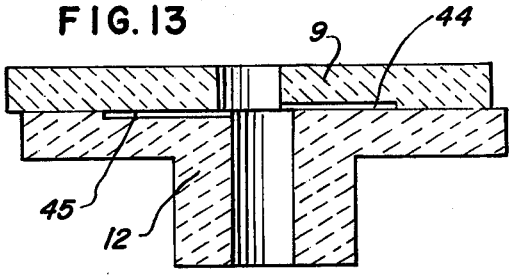
Figure 14:
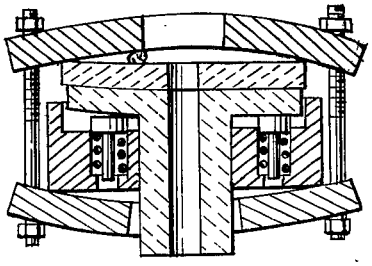

Alternatively, where the same abrasion takes place along the face and the edges where the present invention is employed, as illustrated in FIGS. 12 and 13, it will be seen that this abrasion is accommodated by the yieldable co-action between the faces, and particularly as shown in FIG. 13, the abrasion occurring at the extension of the faces 44, 45 is still well within the confines of the periphery of the outer extreme of the slide gate 12 and the stationary top plate 9. Even as shown in FIG. 14 where the upper portion of the stationary top plate 9 may be warped, and contamination occur between it and the mounting plate 66, there is still a positive seal provided at the outer extremes of the stationary base plate 9, and of course the sliding members continue to seal in the fashion as illustrated and described in connection with FIGS. 12 and 13 above.

ALTERNATIVE EMBODIMENT

Figure 15:
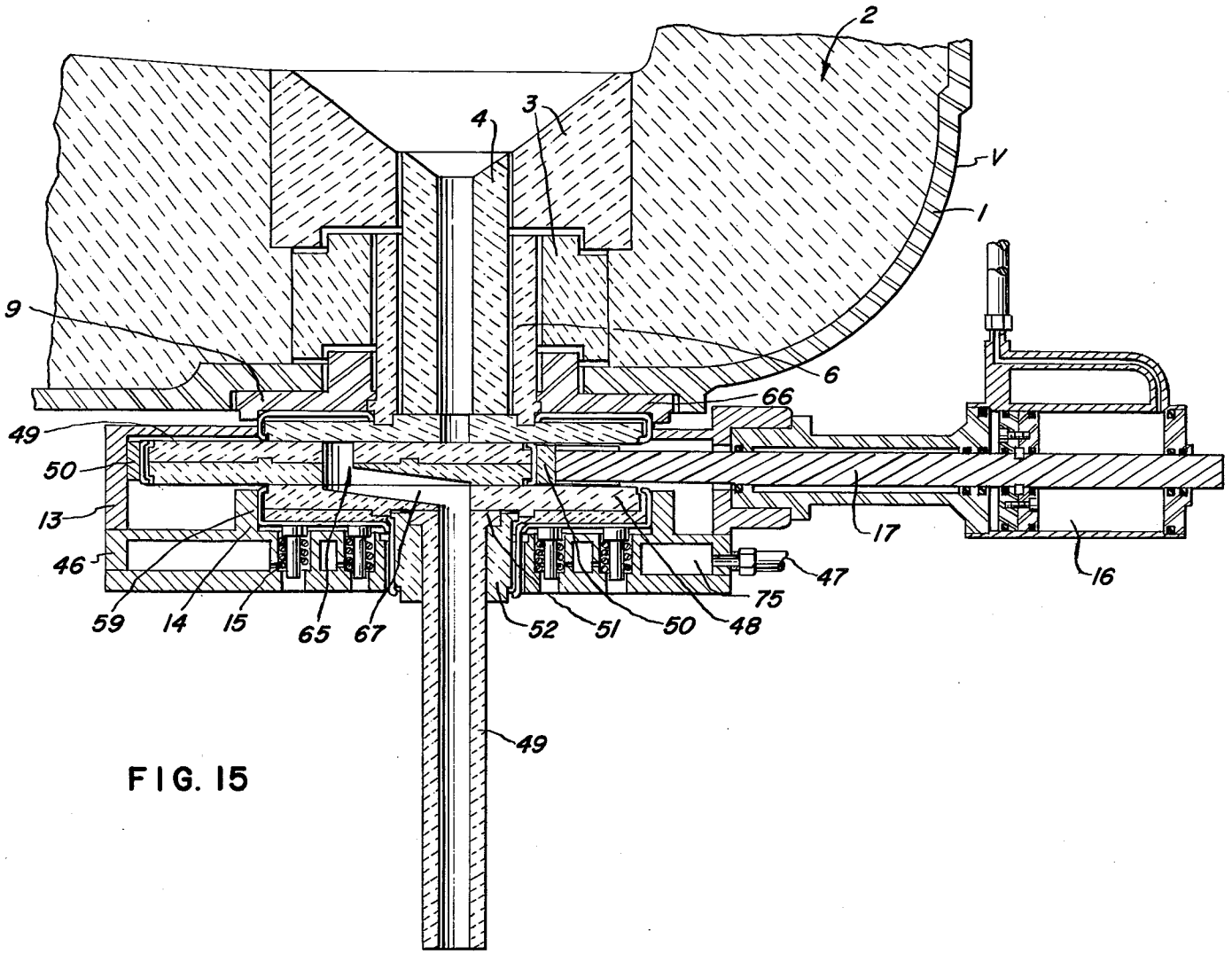
FIG. 15 is a longitudinal transverse sectional view of a teeming valve illustrative of an alternative embodiment of the present invention in which a submerged pour tube may be utilized the relationship to the pouring vessel of which is not disturbed in the course of reciprocating the valves to actuate and deactivate the flow of molten metal.

The alternative embodiment of the valve of the present invention disclosed in FIG. 15 is directed primarily to the provision of a submerged pouring tube 49 and nozzle extension 52 at the lower portion of the frame 13 of a sliding gate valve 5. As the description continues of the alternative embodiment in FIG. 15 it will be observed that where common reference numerals are applicable, the same have been employed. Noting more particularly the host environment, a vessel V having a metal outer case 1 is employed with a refractory lining 2 terminating in well blocks 3 at the central portion thereof. A safety nozzle 6 of similar material of the main embodiment of the present invention is employed, and the stationary top plate 9 is encased in metal and otherwise formed with a locking annular ring and co-acts with the safety nozzle 6 as in the first embodiment described. The same are received within a recess in the mounting plate 66 of the sliding gate valve 5, the former being secured to the metal base 1 of the vessel V.

In this instance, however, a carrier 50, much in the configuration of a wrap-around frame is secured to the rod 17 which is actuated by the hydraulic piston 16. The air cooling for the load pads 15 is provided by means of an alternatively located air connection 47 which, in turn, directs the air throughout the portion of the main frame 13 which is separated therefrom by means of the spacer 46.

To be further noted is the pressure of the load pads 15 is directed against the nozzle extension 52, and also that the sliding gate 49 comprises a two piece refractory so that the high erosion resistant refractory interface R—R between the stationary top plate 9 and the movable sliding gate 49 remain the same as in the principal embodiment and co-acts in the fashion described in the method above. Offset portions 65,67 are provided respectively in the sliding gate 49 and the upper face of the head portion 51 of the submerged pour tube and nozzle extension elements. Thus as the sliding gate 49 is reciprocated to the far right position (not shown) the pour aperture positioned centrally of the sliding gate 49 is aligned with the pouring aperture of the working nozzle 4, and directed downwardly through the submerged pour tube 49. Alternatively in the shut off position as shown in FIG. 15, a positive blocking occurs between the upper face of the sliding gate 49 and the lower face of the stationary top plate 9, the two being refractory surfaces R and held in such interfacial pressure relationship by means of the load pads 15. The load pads 15, as in the first embodiment described, are constantly cooled by means of the injection of air through the connection 47 and through the air chamber 75 provided in the interior portion of the frame 13 - 14. As to the latter, it will be observed that an upstanding barrier wall 59 is provided immediately above the level of the spacer 46 to securely hold in position the nozzle extension 52 and its head portion 51 as well as the extension pour tube 49 so that the only moving part is the sliding gate 49 held in position by means of the load pads 15 as described above so that constant pressure is exerted against the co-acting refractory faces R to thereby accommodate any abrasion occurring due to the pour in the open or closed position.

In review it will be seen that two embodiments of a teeming valve for a vessel have been shown and described, both of which have in common a sliding refractory member which is yieldably urged against a fixed refractory member. The method is also shown and described whereby yieldable means are employed to constantly urge two refractory faces in yieldable contact each with the other to thereby accommodate irregularities and provide a seal during use. A practical mechanism has particularly been shown for the tooling of spring loaded load pads in both of the structural embodiments, and also a mechanism for opening and closing the sliding gate valve 5 by means of toggle mechanisms which permit the ready replacement of those refractory parts which become spent in the course of operation.

Although particular embodiments of the invention have been shown and described in full here, there is no intention to thereby limit the invention to the details of such embodiments. On the contrary, the intention is to cover all modifications, alternatives, embodiments, usages and equivalents of a teeming valve, inserts, and method of pouring as fall within the spirit and scope of the invention, specification and the appended claims.

We claim:

1. A valve for use on a vessel for discharging a fluid comprising, in combination, means defining a working nozzle having an opening at an outer portion of said vessel, means in fixed relation to the vessel defining a refractory surface surrounding said working nozzle opening, a frame secured to the vessel for supporting a sliding member, a sliding member comprising a refractory surface portion, a carrier, and a teeming opening at an inner portion thereof, said frame having guide means cooperating with said carrier to maintain said refractory surfaces in opposed sliding relationship, a plurality of yieldable means surrounding the working nozzle opening exerting a yieldable effort opposed by said frame and directed against the sliding member refractory, said yieldable means being disposed intermediate the edges of the refractory and teeming opening and in opposed relationship with at least one such yieldable means substantially in front and one such yieldable means substantially behind the teeming opening along the path of movement, to thereby deflect the refractory surface of the sliding member to conform to the shape of the refractory surface surrounding the working nozzle opening.

2. In the valve for use on a vessel for discharge of fluid of the character defined in claim 1 above, said means for defining a working nozzle having an annular space thereabout at the lower end portion thereof, a safety nozzle proportioned for a sliding collar fit into the annular space provided about said working nozzle, and means in the upper portion of said means in fixed relation to the vessel defining a refractory surface surrounding said working nozzle for a labyrinth engagement with the base of said safety nozzle in shut off relationship between the safety nozzle and said refractory surface surrounding said working nozzle opening.

3. In a valve for use on a vessel for discharge of fluid of the character defined in claim 1 above, air chamber means in confining communication with the yieldable means, and air supply means operatively connected to said air chamber to air cool the yieldable means.

4. In a valve for use on a vessel for discharge of fluid of the character defined in claim 1 above, drive means for reciprocating said sliding member, said drive means having a rod connection to the carrier thereof, and a quick disconnect for securing said drive means to said carrier.

5. In a valve for use on a vessel for discharge of fluid of the character defined in claim 4 above, said drive means including a one piece hollow rod for connection in air cooling relationship with said carrier.

6. In a valve for use on a vessel for discharge of fluid of the character defined in claim 5 above, means for passing cooling air through said hollow rod, and, air confining means coupled to said hollow rod and in confined communicating relationship with said yieldable means for air cooling.

7. In the valve for use on a vessel for discharge of fluid as defined in claim 1 above, said yieldable means comprising pressure pads which are yieldably urged by coil springs, said pressure pads having means to limit the travel of said pressure pads, whereby the pressure pads may be preloaded.

8. In the valve for use on a vessel for discharge of fluid as defined in claim 1 above, toggle actuated means for securing said frame and carrier to said vessel.

9. In the valve for use on a vessel for discharge of fluid as defined in claim 8 above, said toggle means having a travel limit calculated to load said yieldable means to their desired working load.

10. In a valve for use on a vessel for discharge of fluid of the character defined in claim 1 above, toggle actuated means for securing said frame and carrier to said vessel, said toggle means including toggle hinge means and toggle latch means in opposed relationship to said toggle hinge means, whereby the frame and carrier may be hingedly withdrawn from said vessel for the replacement of said refractories, and thereafter hingedly resecured to the same.

11. In a valve for use in a vessel for discharge of fluid of the character defined in claim 10 above, said hinge means including extension means to permit the withdrawal of said frame and carrier from said vessel prior to pivoting about the toggle hinge means.

12. In a valve for use on a vessel for discharge of fluid as defined in claim 11 above, said yieldable means having a longitudinal travel limit, said extension means of the hinge toggle of said toggle means permitting movement exceeding the longitudinal travel limit of said yieldable means, said toggle means being proportioned to deflect said yieldable means a distance to provide the desired pressure loading between said refractory faces.

13. A valve for use on a vessel for discharging a fluid comprising, in combination, means defining a working nozzle having an opening at an outer portion of said vessel, means in fixed relation to the vessel defining a replaceable first refractory with a refractory surface beneath said working nozzle opening and having a teeming opening therethrough, a frame hingedly secured to the vessel for supporting a sliding member, said sliding member comprising a second replaceable refractory with a refractory surface, a carrier, and a teeming opening at an inner portion thereof, said frame having guide means cooperating with said carrier to maintain said refractory surfaces in opposed sliding relationship, a plurality of yieldable means positioned to urge pressure face to face contact between said refractory surfaces in opposed sliding relationship, toggle actuated means for securing said frame and said carrier to said vessel, said toggle actuated means having a travel limit calculated to load said yieldable means to their desired working load, and driving means for imparting relative motion between said sliding member teeming opening and said nozzle opening to control the discharge of fluid from said vessel, whereby the frame and carrier may be hingedly withdrawn from said vessel for the replacement of said refractories, and thereafter hingedly resecured to the same.

14. In a valve for use on a vessel for discharging a fluid of claim 13, said sliding member having in addition to its refractory surface portion a depending refractory member defining a teeming opening at the central portion thereof, said yieldable means surrounding the teeming opening and depending refractory portion at a plurality of spaced positions thereabout.

15. In the valve for use on a vessel for discharging a fluid as defined in claim 14 above, a refractory tube extending downwardly from said depending refractory portion beneath said frame and valve to shield the stream of molten material poured therethrough from atmosphere.

16. In the valve for use on a vessel for discharging a fluid defined in claim 13 above, said sliding member having a tubular insert defining the teeming opening, said tubular member being formed of an erosion resistant refractory, said tubular member extending completely from the open end of said teeming opening to the refractory surface portion at its upper end in an unbroken connecting relationship.

17. In combination with a valve as defined in claim 13 above, a removably secured sliding element and removably secured stationary element, said elements serving, respectively, as said second and first replaceable refractories, and each having refractory faces for yieldable pressure engagement with the other, said stationary element having a metal casing thereabout, said sliding element having an upper face portion of high erosion resistant refractory, said sliding element having a depending portion engaging said upper face portion and extending downwardly therefrom defining a portion of an interior opening, said sliding element having a metal casing thereabout containing the upper face portion and the depending portion.

18. In the combination of claim 17, an erosion resistant refractory sleeve in the central portion of said sliding member and extending from the bottom of said depending nozzle portion to a position at the top coplanar with the refractory face of said sliding member.

19. In the combination of claim 17 above, means defining an annular recessed ring around said teeming opening in said stationary element to receive the complementary end of a safety nozzle.

20. A valve for use on a vessel for discharging a fluid comprising, in combination, means defining a working nozzle having an opening at an outer portion of said vessel, means in fixed relation to the vessel defining a metal encased replaceable refractory with a refactory surface beneath said working nozzle opening and having a teeming opening, a frame secured to the vessel for supporting a sliding member, a sliding member comprising a metal encased replaceable refractory with opposed refractory surface portions and having a teeming opening at an inner portion thereof, a carrier for said sliding member, said frame having guide means cooperating with said carrier to maintain said refractory surfaces in opposed sliding relationship, said frame guide means including a refractory surface of an element held in a stationary retaining portion of the frame having a teeming opening at an inner portion thereof, a plurality of yieldable means acting between the frame and said guide means in surrounding longitudinal and lateral relationship to said guide means teeming opening to urge pressure face to face contact between said refractory surfaces at least one such yieldable means being diametrically opposed to another in flanking relationship to the teeming opening in the sliding member along the path of movement, and driving means for imparting relative motion between said sliding member teeming opening and said working nozzle opening to control the discharge of fluid from said vessel.

21. In the valve for use on a vessel for discharging a fluid as defined in claim 20 above, a stationary bottom refractory secured within the said frame beneath said sliding member and extending downwardly therefrom, a refractory tube extending downwardly from said stationary bottom refractory beneath said frame and valve to shield the stream of molten material poured therethrough from atmosphere.

22. In a valve for use on a vessel for discharging a fluid of the character defined in claim 20 above, an interface defined by the lower face of the sliding member and the upper refractory surface of said guide means, an offset recess in one of said refractory faces, said face being in sliding relationship with the other refractory face, whereby constant draining is provided to inhibit the freezing of fluid within the teeming opening of the sliding member.

23. A method of accommodating irregularities in a fluid sealing relationship between refractory surfaces in which each surface has a teeming opening and in which the same are mounted for alignment for the purposes of controlling the flow of molten fluid, the steps comprising:

holding one of the refractory surfaces in fixed position, confining the other refractory surface for relative motion with regard to the fixed refractory surface, moving the other refractory surface to align the openings to permit pouring, applying pressure at a plurality of locations to the other refractory surface, the pressure being applied at longitudinal and lateral positions surrounding the teeming openings within the periphery of the outer edge of the fixed refractory surface and intermediate the edges and teeming opening of the other refractory surface in opposed relationship with at least one such location substantially in front and one such location substantially behind the teeming opening along the path of movement, whereby the other refractory surface is deflected to conform to the irregularities of the surface of the fixed refractory member.

24. In the method of claim 23, confining and circulating a stream of fluid in close communication with said locations for cooling the same beneath their upper limits of operating temperature.

25. In the method of claim 24, using air as the cooling fluid.

26. For use with a valve for discharging fluids from a vessel, replaceable refractory members for reciprocatory sliding face contact having, a sliding refractory member, a stationary refractory member on the vessel side of the sliding refractory member, and a stationary refractory member on the side of the sliding member away from the vessel, means defining a teeming opening interior of the refractory members, driving means engaging means to move the sliding refractory member so that its teeming opening may be moved into and out of alignment with the teeming opening of the stationary refractory member on the vessel side, a recess in asymmetrical relationship with respect to the axis of the teeming opening in one of the refractory members that abuts the interface between the sliding refractory member and the stationary refractory member on the side away from the vessel and in open communication with the adjacent teeming opening throughout the stroke of the sliding refractory member.

27. In a ladle gate valve for a vessel comprising means defining a working nozzle having an opening at an outer portion of said vessel, means in fixed relation to the vessel defining a refractory surface surrounding said working nozzle opening, a frame secured to the vessel for supporting a sliding member, a sliding member including a carrier supported in said frame, and a plurality of yieldable means in surrounding relationship to the working nozzle and within the carrier, the improvement comprising:

a replaceable metal encased refractory member for reciprocatory sliding refractory face contact with the refractory surface surrounding the working nozzle and proportioned for insertion within the carrier, means defining a teeming opening and depending nozzle at a mid-portion of the refractory member, said refractory member and depending nozzle being peripherally encased in a metal enclosure, said refractory member being bilaterally symmetrical about a plane defined by the axis of reciprocation and the axis of the teeming opening, said refractory member being bilaterally symmetrical about the plane passing through the axis of the teeming opening and perpendicular to the axis of reciprocation, whereby said refractory member may be inserted and removed and reversed for reuse with said ladle gate valve.

28. In the ladle gate valve of claim 27 above, the refractory surface surrounding the working nozzle being formed by a stationary top plate having a flat refractory body and having a central teeming opening for use in relative reciprocating motion and in and out of register with the said replaceable metal encased refractory.

29. In a ladle gate valve wherein a reciprocating gate is used with said valve for discharging fluids from a vessel wherein the reciprocating gate is engaged at its lower portion by yieldable means and having a port at a center portion thereof; and a stationary top plate with a port and having a refractory face in relative slidable relationship to a refractory face on the reciprocating gate; and where the yieldable means promote sealed face to face contact between the stationary plate refractory face and the reciprocating gate refractory face, the combination with said valve of a replaceable reciprocating gate and a replaceable stationary top plate, the replaceable reciprocating gate comprising, a refractory member including an upper portion having a continuous sliding face, a peripheral continuous sidewall depending from said continuous sliding face, a lower surface beneath the sliding face, a depending nozzle extending below said lower surface, a teeming passage through said nozzle and opening through the sliding face at its mid-portion, a metal encasing means having a portion surrounding the continuous sidewall to contain the refractory, a portion surrounding the nozzle periphery, and an intermediate yieldable means engaging portion extending from and joining the lower extremity of said sidewall encasing portions and extending centrally to the nozzle, and having a yieldable means engaging face whereby the pressure from the yieldable means is transferred to an increased portion of the refractory to thereby yieldably urge the opposed sliding faces into sealed relationship, said refractory member having its sliding face formed of a refractory having a high erosion resistence, said depending nozzle having at least a portion of its teeming opening formed of a refractory having a high erosion resistance, said refractory member being bilaterally symmetrical about a plane defined by the axis of reciprocation and the axis of the teeming opening, said refractory member being bilaterally symmetrical about the plane passing through the axis of the teeming opening and perpendicular to the axis of reciprocation, whereby said gate member may be inserted and removed and reversed and reinserted for use as a part of the valve, the metal encasing means serving to contain cracked refractory occasioned by thermal expansion and contraction, and the metal portion beneath the sliding face serving to translate the effort of the yieldable means into face to face compressive relationship of the refractories to sealingly and slidingly engage the same, said replaceable stationary top plate comprising a second metal encased refractory member, said top plate being bilaterally symmetrical and having a bottom refractory surface which is a mirror image of the sliding face of the reciprocating gate, a continuous side wall terminating at said surface, a central teeming opening in said top plate and a continuous metal encasing means having a portion peripherally surrounding the side wall and a portion overlying a substantial portion of the top surface of the top plate, whereby the pair of top plate and gate may be removed, or reversed, or reinserted, or replaced, the metal encasing means serving to contain cracked refractory caused by the thermal expansion or contraction.

30. A top plate for use with a valve for discharging fluids from a vessel wherein the top plate is in pouring communication with the vessel and wherein a reciprocating gate is engaged at its lower portion by yieldable means and has a port at a center portion thereof; the stationary top plate having a refractory face in relative slidable relationship with a refractory face on the reciprocating gate; and wherein the yieldable means promote sealed face to face contact between the stationary plate refractory face and the reciprocating gate refractory face, said top plate comprising:

a refractory slab including a lower portion having a face which is adapted to mate with the sliding face of the reciprocating gate, a peripheral continuous sidewall extending upwardly from said lower face portion, an upper face with an outer portion and an inner portion having a central teeming opening extending from the upper face to the lower face for mating pour relationship with the reciprocating gate, a continuous metal encasing means having a portion peripherally surrounding the continuous sidewall and intermediate metal means overlying a substantial portion of said upper face, said intermediate metal means extending from the peripheral portion centrally toward the teeming opening but terminating short of the same, said refractory member having its sliding face formed of a refractory having a high erosion resistance, said refractory member and its surrounding metal member being bilaterally symmetrical about a plane defined by the axis of reciprocation and the axis of the teeming opening, said refractory member being bilaterally symmetrical about the plate passing through the axis of the teeming opening and perpendicular to the axis of reciprocation of the reciprocating member, whereby said top plate may be inserted and removed and reversed and reinserted for use as a part of the valve structure, the metal encasing means serving to contain cracked refractory occasioned by thermal expansion and contraction.

31. In the top plate of claim 30, the ends of said top plate and peripheral metal encasing means being rounded whereby stress points are minimized and material is reduced.

32. In the top plate of claim 31, the face of the top plate being complementary with the face of the associated reciprocating gate.

33. In the top plate of claim 32, a labyrinth lock provided around the teeming opening and interiorly of the intermediate metal means.

34. In the top plate of claim 30, the face of the top plate being complementary with the face of the associated reciprocating gate.

35. In the top plate of claim 30, a labyrinth lock provided around the teeming opening and interiorly of the intermediate metal means.

36. In combination with the top plate of claim 30, a second refractory metal encased member, said second member comprising a reciprocating gate, having, a refractory member with a teeming opening and an upper sliding surface;

a nozzle having a teeming opening depending from said refractory member, a continuous metal encasing means surrounding the refractory member and nozzle, whereby the pair of top plate and gate may be removed, or reversed or reinserted, or replaced, the metal encasing means serving to contain cracked refractory caused by thermal expansion or contraction.

37. A valve for use on a vessel for discharging a fluid comprising, in combination, means defining a working nozzle having an opening at an outer portion of said vessel, means in fixed relation to the vessel defining a replaceable first refractory with a refractory surface beneath said working nozzle opening and having a teeming opening therethrough, a frame hingedly secured to the vessel for supporting a sliding member, a sliding member comprising a second replaceable refractory with a refractory surface, a carrier, and a teeming opening at an inner portion thereof, said frame having guide means cooperating with said carrier to maintain said refractory surfaces in opposed sliding relationship, a plurality of yieldable means positioned to urge pressure face to face contact between said refractory surfaces in opposed sliding relationship, and driving means for imparting relative motion between said sliding member teeming opening and said nozzle opening to control the discharge of fluid from said vessel, means defining an air chamber passageway within said carrier, said yieldable means supported within the carrier and acting between the carrier and the second replaceable refractory, and air cooling means connected through said carrier to deliver a flow of air through said air chamber thereby reducing the operating temperature of said yieldable means to a level wherein the same are beneath their upper temperature limit of predictable deflection and loading.

38. A valve for use on a vessel for discharging a fluid comprising, in combination, means defining a working nozzle having an opening at an outer portion of said vessel, means in fixed relation to the vessel defining a replaceable first refractory with a refractory surface beneath said working nozzle opening and having a teeming opening therethrough, a frame hingedly secured to the vessel for supporting a sliding member, a sliding member comprising a second replaceable refractory with a refractory surface, a carrier, and a teeming opening at an inner portion thereof, said frame having guide means cooperating with said carrier to maintain said refractory surfaces in opposed sliding relationship, a plurality of yieldable means positioned to urge pressure face to face contact between said refractory surfaces in opposed sliding relationship, and driving means for imparting relative motion between said sliding member teeming opening and said nozzle opening to control the discharge of fluid from said vessel, a nozzle depending from said sliding member, a flat spatter shield having an opening in a central portion thereof to surroundingly receive the depending nozzle from said sliding member, and means in said frame for slidingly engaging said spatter shield in its surrounding relationship with said sliding member and nozzle to thereby shield the interior of said frame from spatter and heat developed through the pour through said teeming opening.

39. In a ladle gate valve wherein a reciprocating gate is used with said valve for discharging fluids from a vessel wherein the reciprocating gate is engaged at its lower portion by yieldable means and having a teeming opening at a center portion thereof; and a stationary top plate with a teeming opening and having a refractory face in relative slidable relationship to a refractory face on the reciprocating gate; and where the yieldable means promote sealed face to face contact between the stationary plate refractory face and the reciprocating gate refractory face, the combination with said valve of a replaceable reciprocating gate comprising, a refractory member including an upper portion having a continuous sliding face, a peripheral continuous sidewall depending from said continuous sliding face, a lower surface beneath the sliding face, a depending nozzle extending below said lower surface, a teeming opening in said nozzle and a teeming opening in the sliding face at its mid-portion, a metal encasing means having a portion surrounding the continuous sidewall to contain the refractory, a portion surrounding the nozzle periphery, and an intermediate yieldable means engaging portion extending from and joining the lower extremity of said sidewall encasing portions and extending centrally to the nozzle, and having a yieldable means engaging face whereby the pressure from the yieldable means is transferred to an increased portion of the refractory to thereby yieldably urge the opposed sliding faces into sealed relationship, said refractory member having its sliding face formed of a refractory having a high erosion resistance, said depending nozzle having at least a portion of its teeming opening formed of a refractory having a high erosion resistance, said refractory member being bilaterally symmetrical about a plane defined by the axis of reciprocation and the axis of the teeming opening, said refractory member being bilaterally symmetrical about the plane passing through the axis of the teeming opening and perpendicular to the axis of reciprocation, a second metal encased refractory top plate member, said second metal encased refractory member having a bilaterally symmetrical top plate, said top plate having a refractory surface which is a mirror image of the sliding face of the reciprocating gate, and a continuous sidewall depending from said surface, and a central teeming opening, a continuous metal encasing means having a portion peripherally surrounding the sidewall of said top plate and extending from the peripheral portion centrally toward the teeming opening but stopping short of the same, whereby the pair of top plate and gate may be removed, or reversed or reinserted, or replaced, the metal encasing means serving to contain cracked refractory caused by thermal expansion or contraction.

* * * * *